US010737847B1

(12) United States Patent
Liu

(10) Patent No.: US 10,737,847 B1
(45) Date of Patent: Aug. 11, 2020

(54) COVER STRUCTURE OF SEALED CAN

(71) Applicants: FREE-FREE(USA) INC; FREE-FREE INDUSTRIAL CORP, Taipei (TW)

(72) Inventor: Sheng-Yu Liu, Taipei (TW)

(73) Assignees: FREE-FREE(USA) INC, Ontario, CA (US); FREE-FREE INDUSTRIAL CORP, Taipei (TW)

( * ) Notice: Subject to any disclaimer, the term of this patent is extended or adjusted under 35 U.S.C. 154(b) by 30 days.

(21) Appl. No.: 16/273,917

(22) Filed: Feb. 12, 2019

(51) Int. Cl.

| | |
|---|---|
| ***B65D 43/02*** | (2006.01) |
| ***B65D 43/08*** | (2006.01) |
| ***B65D 45/18*** | (2006.01) |
| ***B65D 81/20*** | (2006.01) |
| ***B65D 43/06*** | (2006.01) |

(52) U.S. Cl.
CPC ..... *B65D 43/0204* (2013.01); *B65D 43/06* (2013.01); *B65D 43/08* (2013.01); *B65D 45/18* (2013.01); *B65D 81/2015* (2013.01); *B65D 2543/00101* (2013.01)

(58) Field of Classification Search
CPC ..... B65D 43/0204; B65D 43/06; B65D 81/2015; B65D 45/18; B65D 43/08; B65D 2543/00101
See application file for complete search history.

(56) References Cited

U.S. PATENT DOCUMENTS

| | | | | |
|---|---|---|---|---|
| 2008/0179274 | A1* | 7/2008 | Cheng | A45F 3/16 215/329 |
| 2009/0114653 | A1* | 5/2009 | Schenker | B65D 25/32 220/324 |
| 2011/0036837 | A1* | 2/2011 | Shang | B65D 45/34 220/240 |
| 2017/0190479 | A1* | 7/2017 | Liu | B65D 39/12 |

* cited by examiner

*Primary Examiner* — James N Smalley
(74) *Attorney, Agent, or Firm* — Chun-Ming Shih; HDLS IPR Services

(57) ABSTRACT

A cover structure of a sealed can includes an upper cover, a lower cover, a handle component, an elastic member and a sealing ring. The upper cover has a through hole; the lower cover is installed under the upper cover; the handle component includes a connecting lever, a shifting handle and a pivot connecting the connecting lever and shifting handle, and the connecting lever passing through the through hole and then connecting the lower cover; each elastic member is elastically clamped between the upper and lower covers; the sealing ring has an end coupled to the lower cover and the other end extending towards the upper cover; the connecting lever is formed at the center of the lower cover, and each elastic member is installed symmetrically on both sides with respect to the connecting lever. This structure features simple structure and uniform force exertion and has good sealing effect.

10 Claims, 9 Drawing Sheets

COVER STRUCTURE OF SEALED CAN

BACKGROUND OF THE INVENTION

1. Technical Field

The technical field relates to a sealed can technology, and more particularly to a cover structure of a sealed can.

2. Description of Related Art

In general, a conventional sealed can comprises a container and a cover for air-tightly covering an opening of the container, and the cover is detachably covered onto the container. To seal the opening of the container air-tightly, a ring-shaped pad is embedded into the bottom edge of the cover, and the airtight pad is installed around the periphery of the opening of the container. Since liquid or powder may penetrate into the sealed can of this sort easily, therefore the ring-shaped pad may be contaminated, or dirt may be accumulated in the gap, or the food contained in the container may have molds or may be contaminated. As a result, it is necessary to disassemble and clean the sealed can, and reassemble the sealed can after the pad and the ring-shaped groove are dried. Obviously, the conventional sealed can is very inconvenient.

In view of the aforementioned drawbacks of the conventional sealed can, related manufacturers developed a sealed can cover having a handle and an elastic member, and the handle is provided for users to press, and the elastic force of the elastic member squeezes and deforms the washer to achieve the sealing effect. However, the sealed can of this soft often has the issues of non-uniform force exertion and deviation which cause a poor sealing effect.

SUMMARY OF THE INVENTION

Therefore, it is a primary object of this disclosure to provide a cover structure of the sealed can including elastic members and upper and lower covers, and the structure is not just simple only, but both of the uniform force exertion and sealing effect are very good.

To achieve the aforementioned and other objectives, this disclosure provides a cover structure of a sealed can, and the cover structure comprises an upper cover, a lower cover, a handle component, a plurality of elastic members and a sealing ring, wherein the upper cover has a through hole; the lower cover is installed under the upper cover and has a shape corresponding to the upper cover; the handle component includes a connecting lever, a shifting handle and a pivot passing and coupling the connecting lever and the shifting handle, and the connecting lever passes through the through hole and then connects the lower cover; each of the elastic members is elastically clamped between the upper cover and the lower cover; an end of the sealing ring is coupled to the other end of the lower cover and extended in a direction towards the upper cover; wherein, the connecting lever is formed at a center position of the lower cover, and each of the elastic members is configured symmetrically on both sides with respect to the connecting lever.

This disclosure has the following effects: The design of the carrying platforms not just increases the elastic force of each elastic member exerting on the upper cover and the lower cover only, but also makes the assembling and positioning easy. The design of the latching groove of latching seat and the elastic hook can improve the easiness of installing the handle component and the lower cover. The design of the hollow column and the protruding column gives a stable positioning effect to each elastic member.

DESCRIPTION OF THE PREFERRED EMBODIMENTS

The technical contents of this disclosure will become apparent with the detailed description of preferred embodiments accompanied with the illustration of related drawings as follows. It is intended that the embodiments and drawings disclosed herein are to be considered illustrative rather than restrictive.

Figure 1:
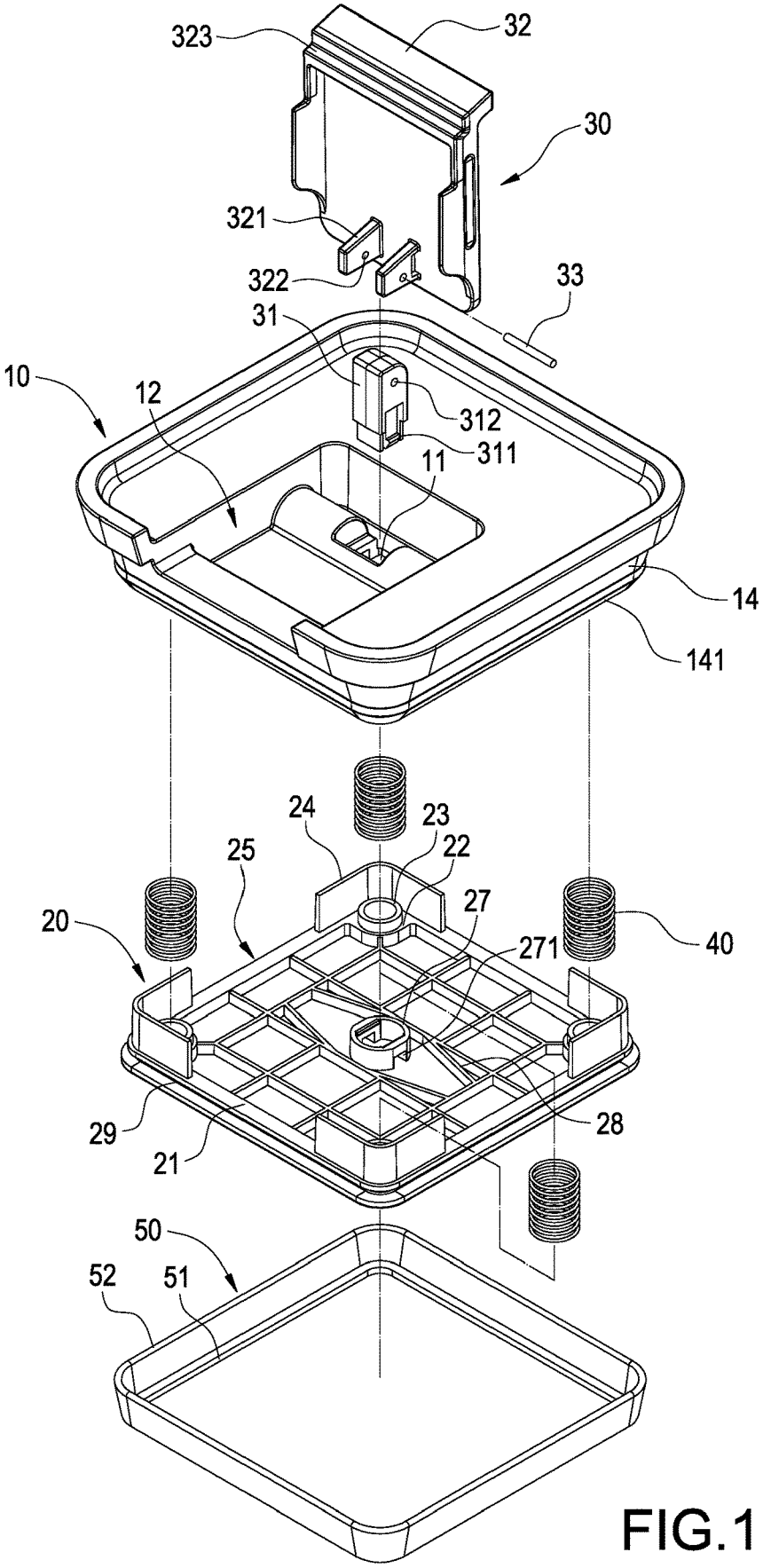
FIG. 1 is an exploded view of a cover structure of this disclosure.
Figure 2:
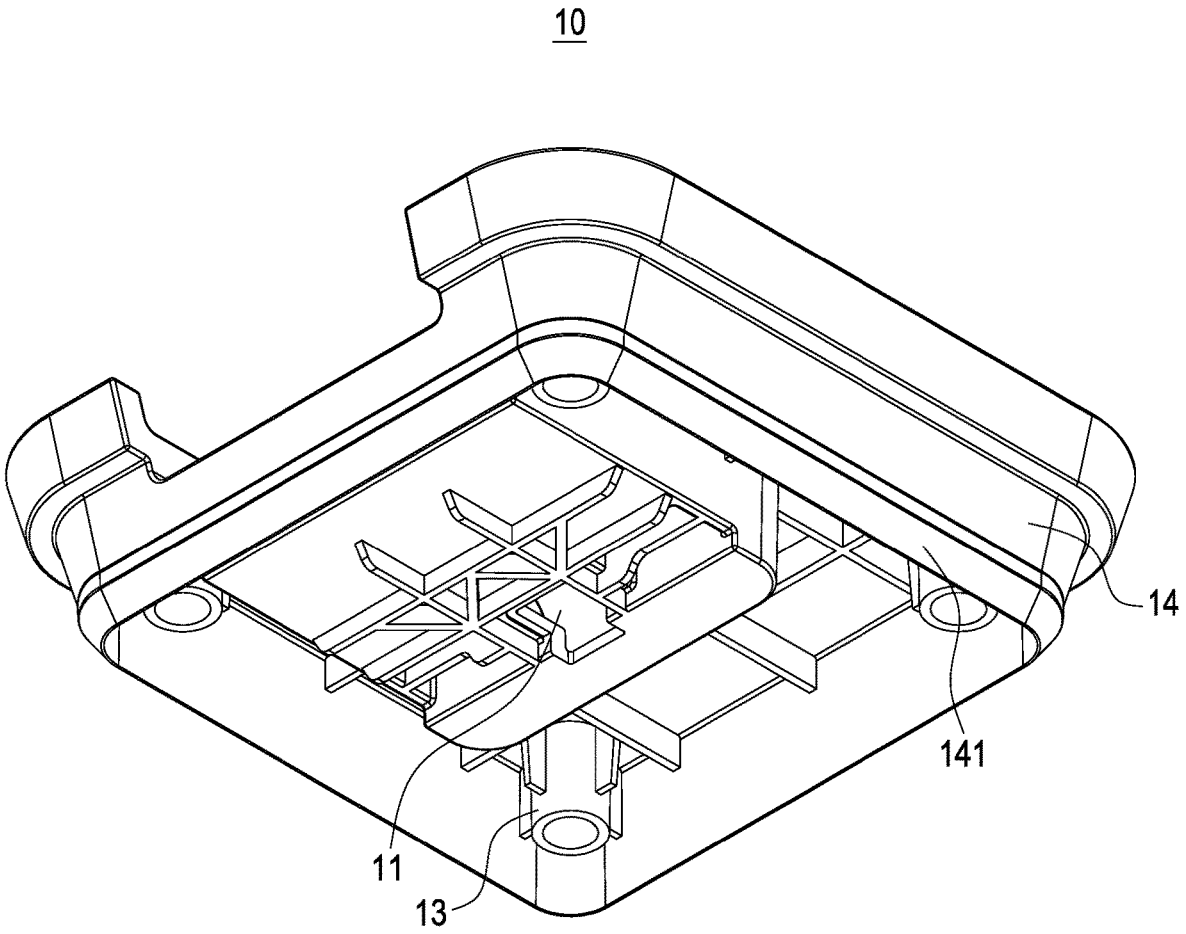
FIG. 2 is a perspective view of an upper cover of this disclosure.
Figure 3:
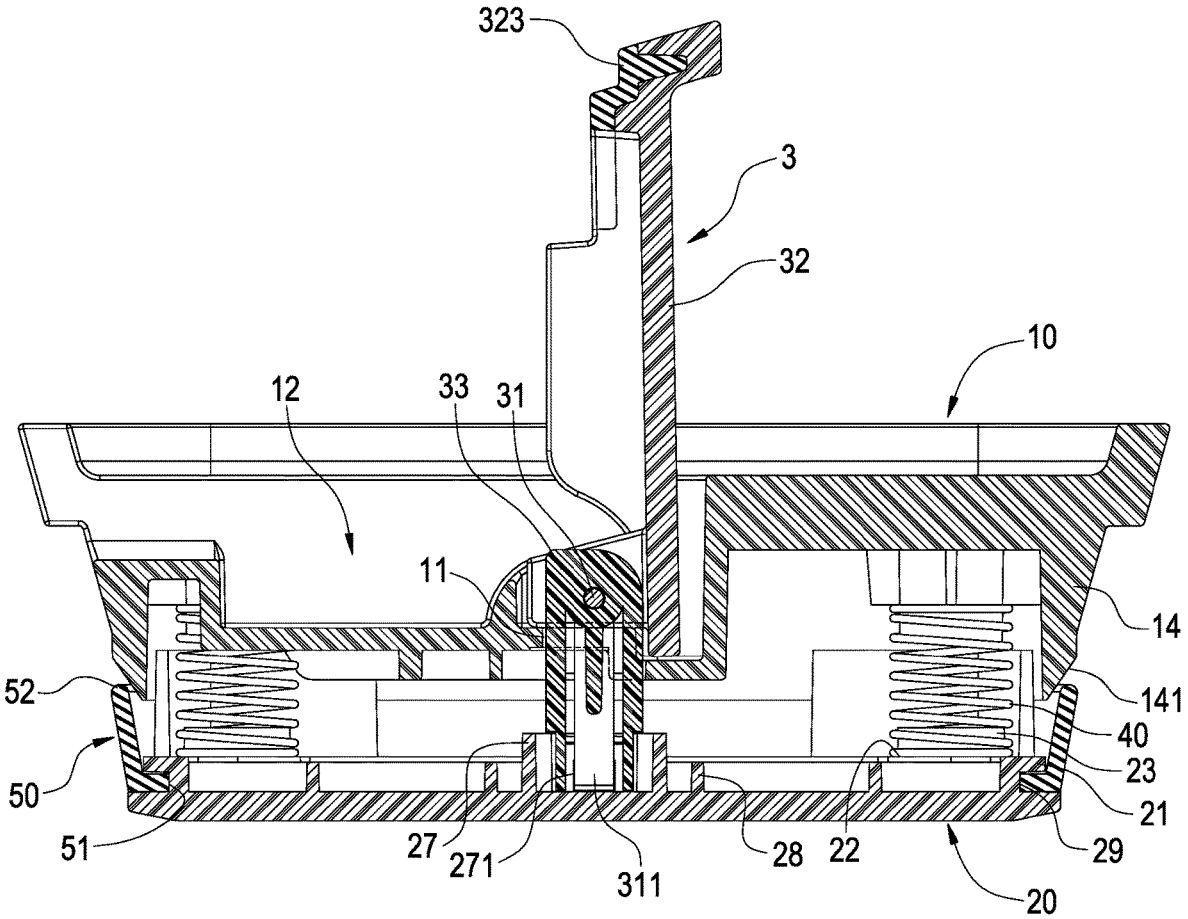
FIG. 3 is a cross-sectional view of a cover structure of this disclosure.
Figure 4:
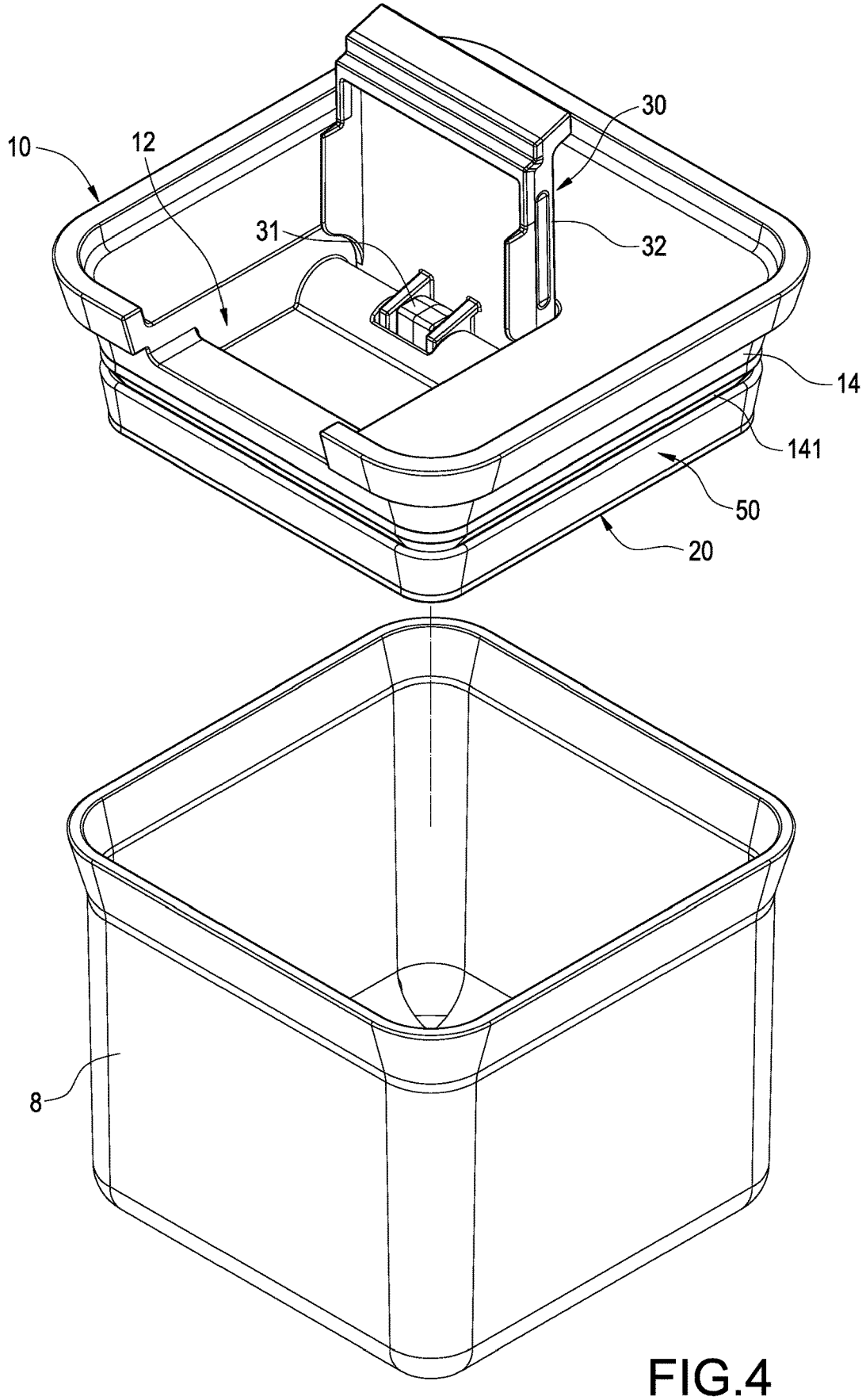
FIG. 4 is an exploded view of a cover structure and a container of this disclosure.
Figure 5:
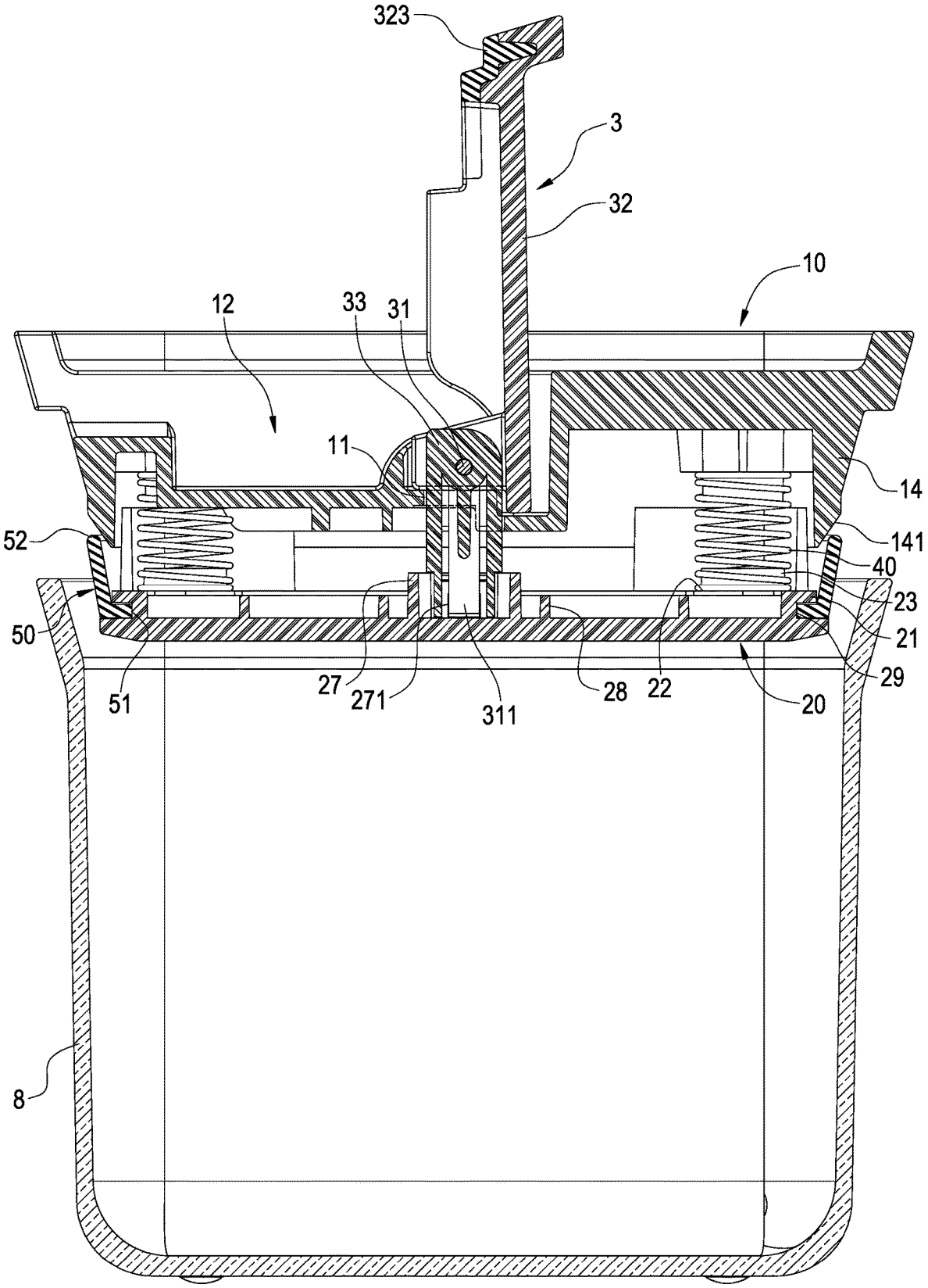
FIG. 5 is a cross-sectional view of a cover structure and a container of this disclosure before they are combined.

With reference to FIGS. 1 and 3 for a cover structure of a sealed can in accordance with this disclosure, the cover structure comprises an upper cover 10, a lower cover 20, a handle component 30, a plurality of elastic members 40 and a sealing ring 50.

The upper cover 10 is a polygon, which is a quadrilateral in this embodiment, but the shape of the upper cover 10 is not limited to this shape only. The upper cover 10 may be made of a plastic material such as polypropylene (PP). The upper cover 10 has a through hole 11 formed at the center thereof, and a depressed area 12 formed in the area of the outer periphery of the through hole 11. In addition, a hollow column 13 is formed and extended downwardly and separately from four corners of the bottom of the upper cover 10, and a ring-shaped frame 14 is formed at the bottom of the upper cover 10, and the ring-shaped frame 14 has an inclined plane 141 formed at the bottom section thereof.

The lower cover 20 is installed at the bottom of upper cover 10 and has a shape substantially corresponding to the upper cover 10, and the lower cover 20 may be made of a plastic material such as acrylonitrile butadiene styrene (ABS), and the lower cover 20 includes a bottom plate 21, and a carrying platform 22 is formed at each corner of the bottom plate 21, and a protruding column 23 is formed at the top of the carrying platform 22, and a fence plate 24 is formed at the outer periphery of each carrying platform 22 and coupled to the bottom plate 21, and a notch 25 is formed between any two adjacent fence plates 24 for discharging the water through each notch 25 easily during the cleaning process. In addition, a latching seat 27 is disposed at a position of the bottom plate 21 corresponding to the through hole 11 of the upper cover 10 and the latching seat 27 has a latching groove 271, and a plurality of ribs 28 formed at the outer periphery of the latching seat 27 for reinforcing the whole structure of the bottom plate 21. In addition, a ring-shaped groove 29 is formed on a side of each edge of the bottom plate 21.

The handle component 30 comprises a connecting lever 31, a shifting handle 32 and a pivot 33, and the connecting lever 31 is made of a plastic material such as polyoxymethylene (POM), and an elastic hook 311 is formed at the bottom section of the connecting lever 31, and a pivot hole 312 is formed at the top section of the connecting lever 31. The shifting handle 32 may be made of a plastic material such as ABS, and two arms are extended from the bottom side of the shifting handle 32, and each arm 321 has a communicating hole 322 formed thereon, and the pivot 33 is passed through and coupled to the pivot hole 312 and the communicating hole 322, so that the shifting handle 32 can be rotated or swung with respect to the connecting lever 31.

Wherein, the connecting lever 31 passes through the through hole 11 of the upper cover 10 and then connects the latching seat 27 of the lower cover 20, and the elastic hook 311 is engaged and fixed to the latching groove 271, so that the connecting lever 31 is formed at the center position of the lower cover 20, and the shifting handle 32 is operatively covered onto the depressed area 12, and the front edge of the shifting handle 32 has a soft component 323 for preventing the shifting handle 32 from producing a loud noise during its rebound process.

In this embodiment, the elastic member 40 is a spiral spring, and the quantity of the elastic members 40 is four. Each elastic member 40 is installed symmetrically on both sides with respect to the connecting lever 31. Further, an end of each elastic member 40 is disposed on the carrying platform 22 and elastically clamped between the upper cover 10 and the lower cover 20. Further, both ends of the elastic member 40 are sheathed on the outer periphery of the hollow column 13 and the outer periphery of the protruding column 23 to define a stable positioning effect.

The sealing ring 50 is made of silicone, and it is substantially a quadrilateral ring body comprising an embedded strip 51 a squeezed and deformed section 52 extended from the embedded strip 51, wherein the embedded strip 51 is fixed to the ring-shaped groove 29, and the squeezed and deformed section 52 is extended in a direction towards the upper cover 10 and formed outside the inclined plane 141.

Figure 6:
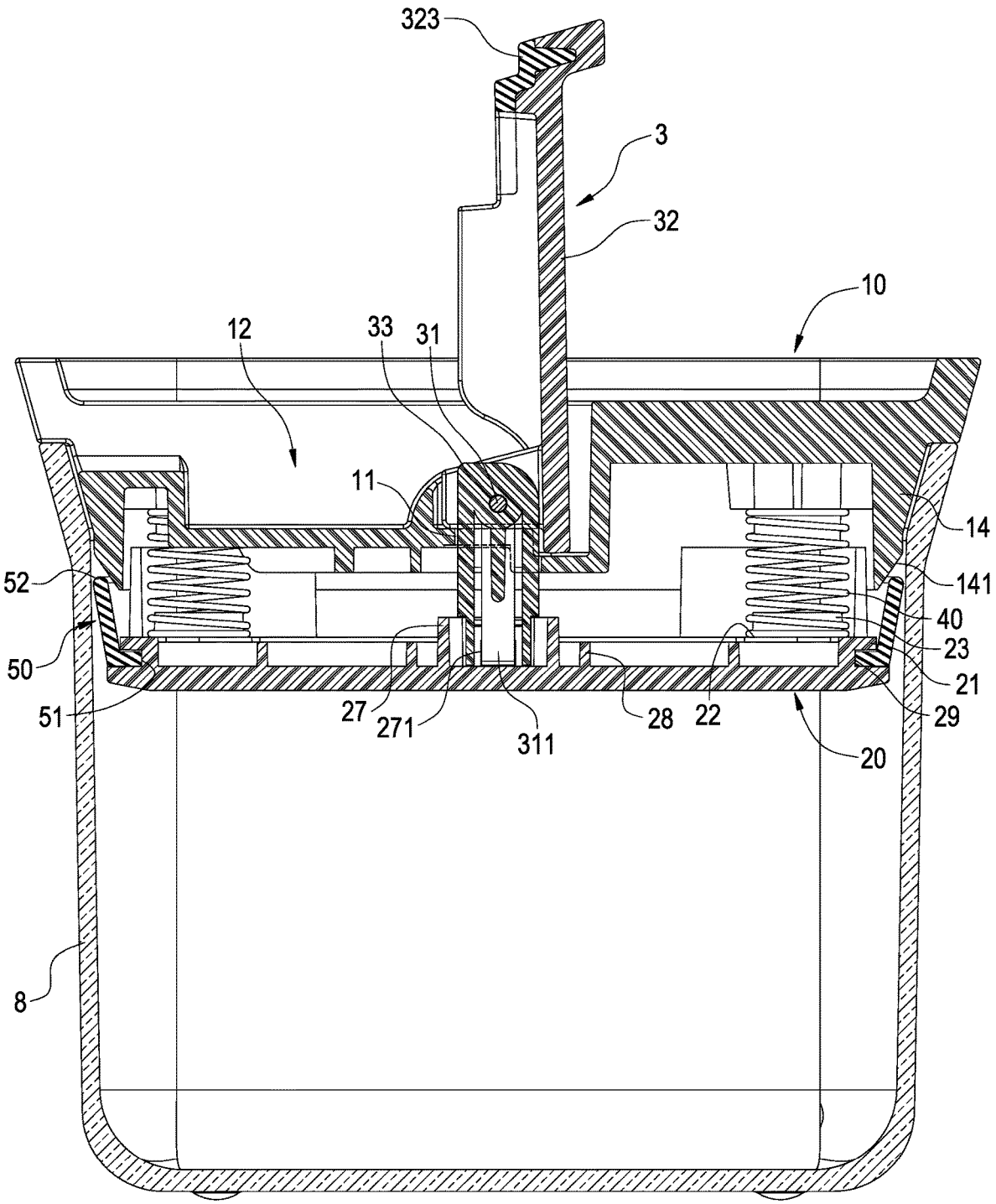
FIG. 6 is a cross-sectional view of a cover structure and a container of this disclosure after they are combined.
Figure 7:
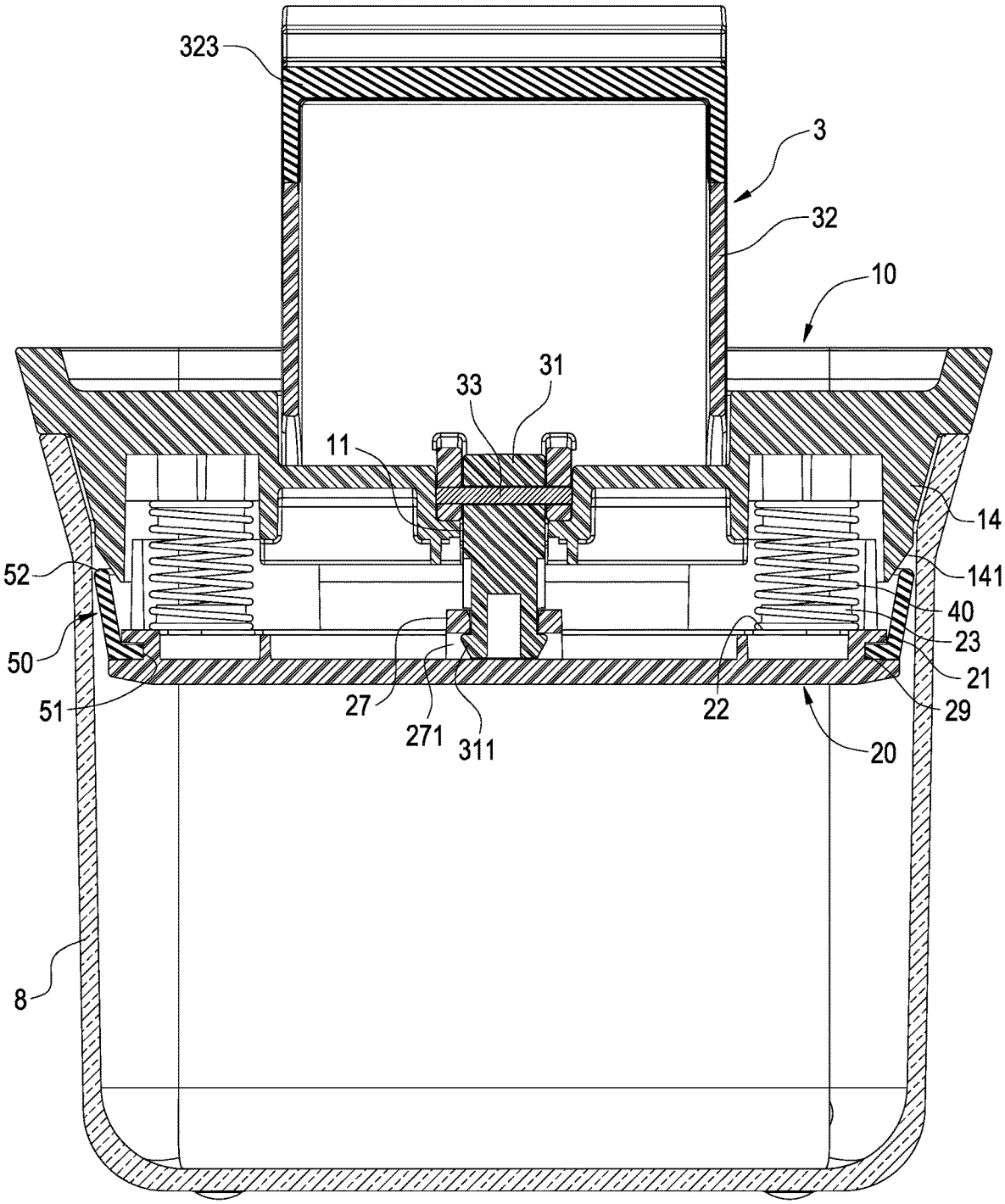
FIG. 7 is another cross-sectional view of a cover structure and a container of this disclosure after they are combined.
Figure 8:
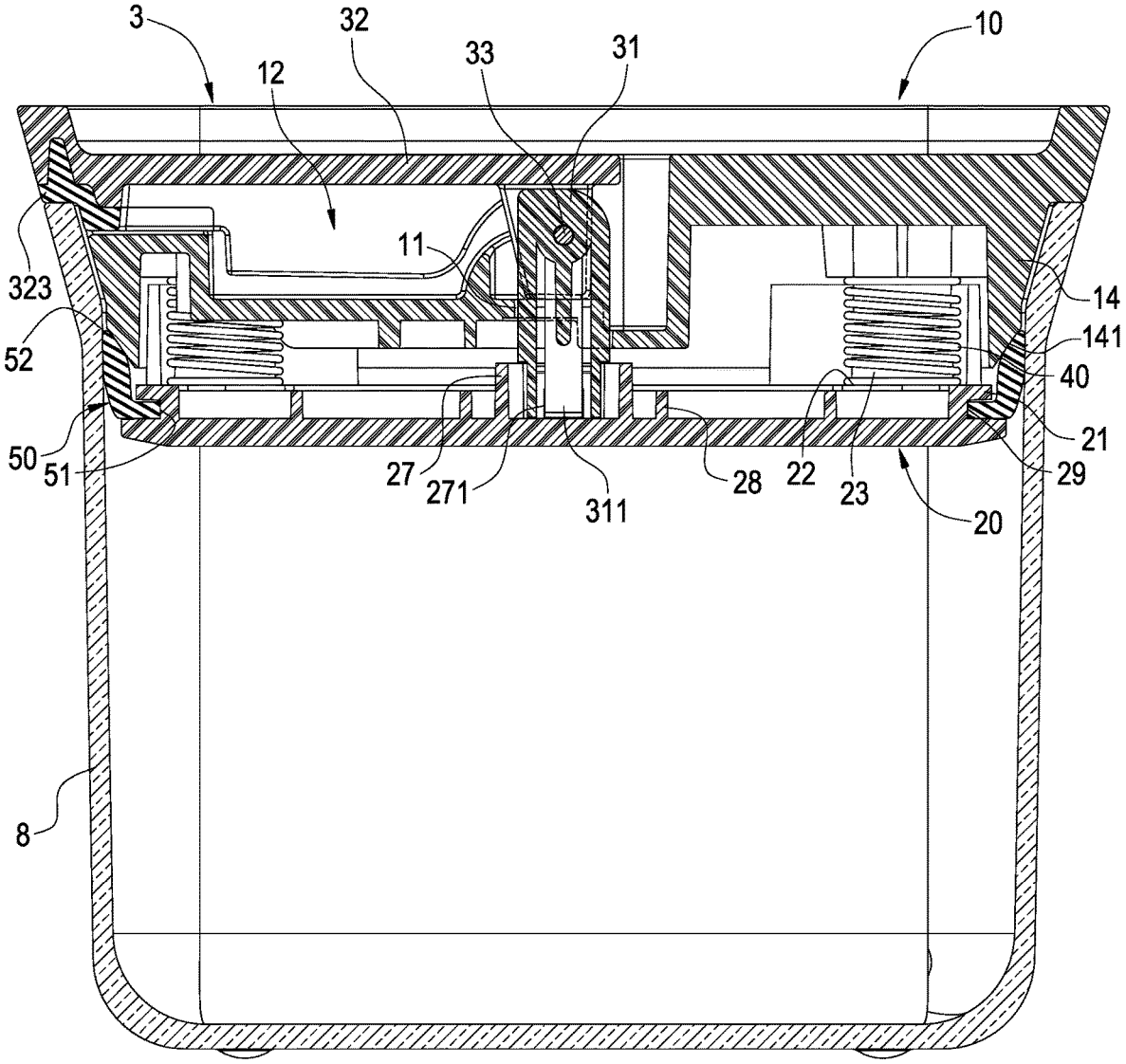
FIG. 8 is a cross-sectional view of a cover structure locked on a cover structure in accordance with this disclosure.

With reference to FIGS. 4 to 8 for a cover structure of a sealed can in accordance with this disclosure, the cover structure is used for combining with a container 8, and the top of the container 8 has an opening formed thereon. During use, the shifting handle 32 is erected, and the cover structure is moved towards the opening of the container 8, and the outer periphery of the upper cover 10 precisely spans across the edge of the opening of the container 8 (as shown in FIGS. 6 and 7). If the shifting handle 32 is pulled and turned horizontally, the connecting lever 31 will drive the lower cover 20 to move towards the upper cover 10. Now, each elastic member 40 is compressed by the upper cover 10 and the lower cover 20. In the meantime, the squeezed and deformed section 52 is pinched between the inclined plane 141 and the inner wall of the container 8 to achieve the sealing effect. On the other hand, if the shifting handle 32 is pulled and turned vertically, the connecting lever 31 will drive the lower cover 20 to move in a direction away from the upper cover 10. Now, each elastic member 40 is released, and the squeezed and deformed section 52 is separated from the position between the inclined plane 141 and the inner wall of the container 8.

Figure 9:
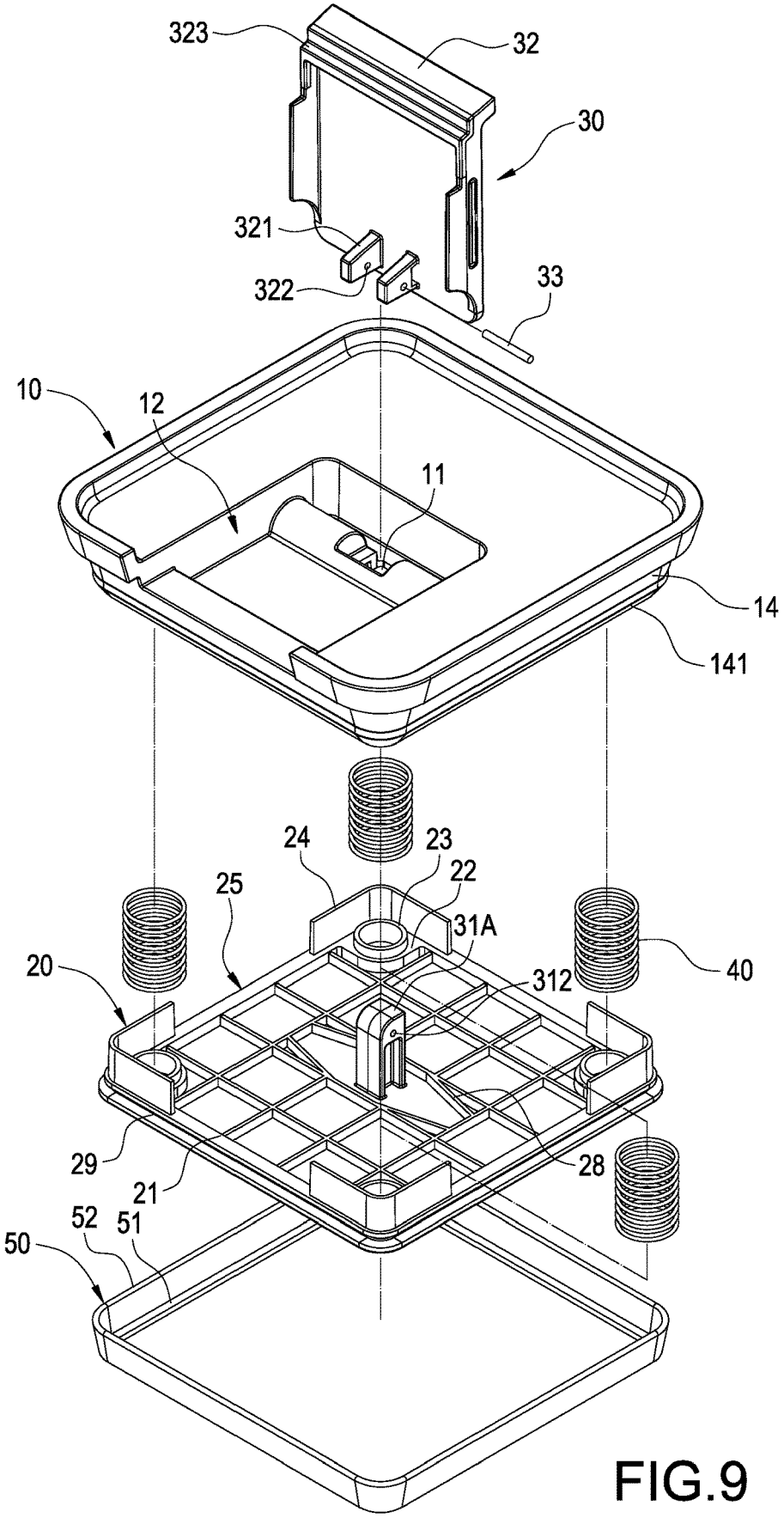
FIG. 9 is an exploded view of a cover structure in accordance with an embodiment of this disclosure cover structure.

With reference to FIG. 9 for a cover structure of a sealed can in accordance with this disclosure, the connecting lever 31A is extended directly from the center position of the bottom plate 21 and provided for passing through the through hole 11 of the upper cover 10 and then the pivot 33 is passed and coupled to the pivot hole 312 and the communicating hole 322 to achieve the effect of rotating and swinging the shifting handle 32 with respect to the connecting lever 31. As a result, this embodiment also has the same or equivalent effect of the aforementioned embodiment.

In summation of the description above, the cover structure of a sealed can in accordance with this disclosure can surely achieve the expected effects and overcome the drawbacks of the prior art, and this disclosure also complies with patent application requirements, and thus is duly filed for patent application.

While this disclosure has been described by means of specific embodiments, numerous modifications and variations could be made thereto by those skilled in the art without departing from the scope and spirit of this disclosure set forth in the claims.

What is claimed is:

1. A cover structure of a sealed can, comprising:

an upper cover, having a through hole formed thereon;

a lower cover, installed under the upper cover, and having a shape corresponding to the upper cover;

a handle component, including a connecting lever, a shifting handle, and a pivot coupled to the connecting lever and the shifting handle, and the connecting lever passing through the through hole and then coupling the lower cover;

a plurality of elastic members, elastically clamped between the upper cover and the lower cover; and a sealing ring, having an end coupled to the lower cover and the other end extending in a direction towards the upper cover;

wherein, the connecting lever is formed at a center position of the lower cover, and each of the elastic members is configured symmetrically on both sides with respect to the connecting lever, wherein the lower cover is a polygon, and each corner of the lower cover has a carrying platform, and an end of the elastic member is disposed on the carrying platform.

2. The cover structure of a sealed can according to claim 1, wherein the sealing ring comprises an embedded strip and a squeezed and deformed section extending from the embedded strip, and the upper cover has a ring-shaped frame formed thereon, an inclined plate formed at the ring-shaped frame, and the lower cover includes a bottom plate, and a ring-shaped groove formed on a side of the bottom plate, and the embedded strip is fixed with respect to the ring-shaped groove, and the squeezed and deformed section is extended in a direction towards the upper cover and formed outside the inclined plane.

3. The cover structure of a sealed can according to claim 1, wherein the lower cover has a latching seat disposed at a position corresponding to the through hole, and the latching seat has a latching groove, and the connecting lever has an elastic hook formed at a bottom section of the connecting lever, and the elastic hook is latched and fixed into the latching groove.

4. The cover structure of a sealed can according to claim 3, wherein the lower cover at the outer periphery of the latching seat has a plurality of ribs formed thereon.

5. The cover structure of a sealed can according to claim 1, wherein each of the elastic members is a spiral spring, and a hollow column is formed at a corner of the upper cover, and a protruding column is formed at the top of the carrying platform, and each of the elastic members is sheathed on the outer periphery of the hollow column and the outer periphery of the protruding column.

6. The cover structure of a sealed can according to claim 1, wherein the shifting handle has a soft component installed at the front edge of the shifting handle.

7. The cover structure of a sealed can according to claim 1, wherein the lower cover includes a bottom plate, and the connecting lever is extended and formed directly from the center position of the bottom plate.

8. The cover structure of a sealed can according to claim 1, wherein the upper cover disposed at the outer periphery of the through hole has a depressed area, and the shifting handle can be operatively covered onto the depressed area.

9. The cover structure of a sealed can according to claim 1, wherein the lower cover includes a bottom plate, and each of the carrying platforms is formed on the bottom plate, and the outer periphery of each of the carrying platforms has a fence plate formed thereon and coupled to the bottom plate, and a notch is formed between any two adjacent fence plates.

10. A cover structure of a sealed can, comprising:

an upper cover, having a through hole formed thereon;

a lower cover, installed under the upper cover, and having a shape corresponding to the upper cover;

a handle component, including a connecting lever, a shifting handle, and a pivot coupled to the connecting lever and the shifting handle, and the connecting lever passing through the through hole and then coupling the lower cover;

a plurality of elastic members, elastically clamped between the upper cover and the lower cover; and a sealing ring, having an end coupled to the lower cover and the other end extending in a direction towards the upper cover;

wherein, the connecting lever is formed at a center position of the lower cover, and each of the elastic members is configured symmetrically on both sides with respect to the connecting lever;

wherein the lower cover includes a bottom plate and a plurality of carrying platforms, and each of the carrying platforms is formed on the bottom plate, and the outer periphery of each of the carrying platforms has a fence plate formed thereon and coupled to the bottom plate, and a notch is formed between any two adjacent fence plates.

* * * * *